United States Patent [19]

Hall et al.

[11] Patent Number: 4,526,493

[45] Date of Patent: Jul. 2, 1985

[54] SLIP-FORMING MACHINE AND PROCESS FOR LAYING CONCRETE MIX ADJACENT TO PLASTIC CONCRETE MIX

[75] Inventors: Howard H. Hall, Ladue; Norman Goff, St. Louis, both of Mo.

[73] Assignee: H. H. H. Concrete Paving Co., St. Louis, Mo.

[21] Appl. No.: 498,460

[22] Filed: May 26, 1983

[51] Int. Cl.[3] ..... E01C 19/48

[52] U.S. Cl. ..... 404/105; 404/104; 404/108

[58] Field of Search ..... 404/105, 106, 108, 101, 404/104, 109, 72, 74; 425/62–64, 425, 426, 429, 432, 456; 264/33

[56] References Cited

U.S. PATENT DOCUMENTS

| | | | |
|---|---|---|---|
| 2,049,115 | 7/1936 | Hadley | 404/72 |
| 2,076,890 | 4/1937 | Heltzel | 404/101 |
| 2,089,094 | 8/1937 | Kime | 404/104 |
| 2,095,414 | 10/1937 | Hemstreet et al. | 404/104 |
| 2,413,632 | 12/1946 | Jackson | 404/104 |
| 3,109,351 | 11/1963 | Dunn | 404/104 |
| 3,359,875 | 12/1967 | Reider | 404/105 X |
| 3,636,831 | 1/1972 | Davin et al. | 404/104 X |
| 3,675,545 | 7/1972 | Anderson et al. | 404/105 |
| 3,709,116 | 1/1973 | Whitbread et al. | 404/105 X |
| 3,710,695 | 1/1973 | Miller et al. | 404/105 X |
| 3,779,661 | 12/1973 | Godbersen | 404/72 |
| 3,856,425 | 12/1974 | Miller et al. | 404/105 X |

*Primary Examiner*—Stephen J. Novosad
*Assistant Examiner*—Beverly E. Hjorth
*Attorney, Agent, or Firm*—Gravely, Lieder & Woodruff

[57] ABSTRACT

One concrete slab is laid adjacent to a previously laid slab with a slip forming machine while the concrete mix of the previously laid slab is still plastic. The slip forming machine includes a tractor of the type used with conventional slip-form mules, and in addition a slip-form mule that has the capability of laying a slab of plastic concrete mix against a previously laid slab of mix that is still plastic. The mule has a frame that is attached to the tractor, and the frame carries a hopper and slip form which are united into a single unit, with the hopper opening into the front end of the slip form. The unitized hopper and slip form pivot on the frame about a vertical axis that extends through the front of the frame. The rear end of the slip form moves on a transverse slideway and a hydraulic cylinder is connected between the frame and slip form to urge the side of the slip form snugly against the edge of the previously laid slab as concrete mix extrudes from the slip form to provide the adjacent slab. This insures that the slabs are in edge-to-edge contact. The elevation of the slip form is controlled by sensors which follow skis, and the skis in turn ride the surface of the previously laid slab. The direction of the tractor, and likewise the slip form which is on it, is controlled by a sensor which follows an edge ski that rides that edge of the previously laid slab against which the extruded slab is laid.

25 Claims, 7 Drawing Figures

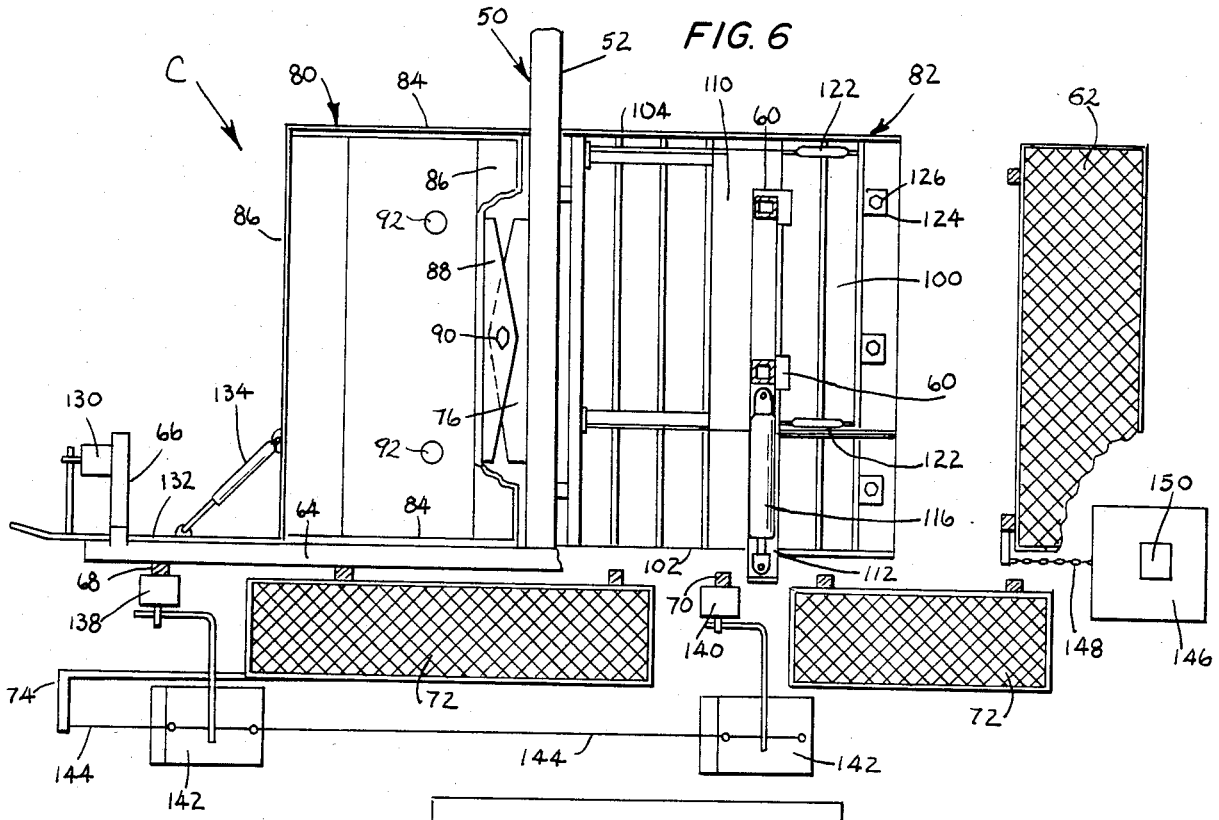
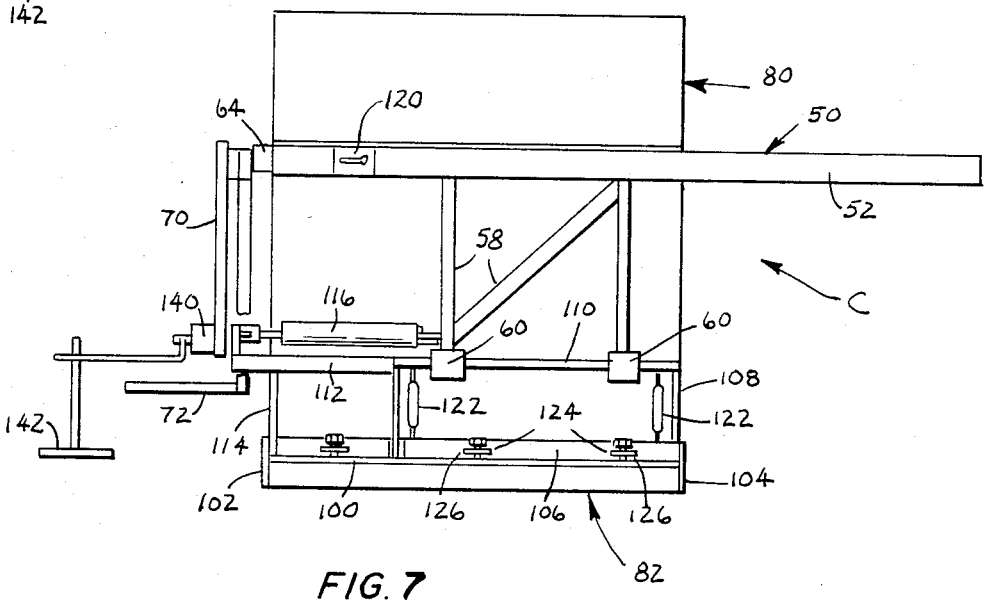
FIG. 7

SLIP-FORMING MACHINE AND PROCESS FOR LAYING CONCRETE MIX ADJACENT TO PLASTIC CONCRETE MIX

BACKGROUND OF THE INVENTION

This invention relates in general to concrete paving, and more particularly to a machine and process for laying slabs of concrete mix against previously laid slabs while the concrete mix of the previously poured slabs is still plastic.

Concrete, although being a highly durable substance, is not widely used for paving large expanses such as parking areas. Instead, most large parking areas are paved with asphalt, primarily because asphalt is easier to apply. In this regard, the asphalt is usually laid over a large expanse in strips, and no difficulty is encountered laying one strip adjacent to a previously laid strip, even though the time between depositing the material of the two strips is only a few minutes. However, asphalt will not support the weight that can be supported by fully cured concrete, and furthermore it will deteriorate when subjected to leaking motor oil and other petroleum products. Also, the significant increase in the cost of crude oil has elevated the cost of asphalt paving to almost as much as that of concrete paving.

Originally concrete paving required the erection of shallow forms over the area to be paved, but this is a time consuming procedure involving much manual labor. Moreover, it proved difficult construct one form adjacent to another so the area was usually paved in strips, with each strip initially being confined by a form and being separated from the adjacent strip by an unpaved strip of equal width. After the forms were removed, the unpaved voids between the strips could be poured to complete the area, but the concrete in the paved strips had to cure sufficiently to gain enough strength to support the concrete carrying vehicles. This usually required at least several days.

This traditional approach has to a measure been rendered obsolete by slip-forming machines which in effect extrude concrete onto the ground in a wide variety of configurations depending on the mule or slip form that is used. For example, some slip forms are suitable for gutters, some for highway barrier walls, and some for curbs. Others are configured for laying sidewalks or paving, but again whenever a large expanse is to be paved, the slip-formed paving must be laid in parallel strips with spaces between adjacent strips. This significantly extends the time for completing the work, since the unpaved intermediate areas between adjacent strips or slabs cannot be paved until the paved regions have cured enough to hold cement-carrying vehicles. Heretofore, it has been impossible to lay a slip-formed slab alongside a previously laid slip-formed slab that is still plastic. The difficulty resides primarily in keeping the slabs at the same elevation and also in steering the slip-forming equipment so that it keeps the slab that it is laying against the previously laid plastic slab. These difficulties exist even though the slip-forming machines are provided with very sensitive control equipment and quite a few adjustments for both steering and elevation.

Thus, present methods of laying concrete paving, even when slip-forming machinery is employed, are not nearly as easy or as rapid as the methods currently used to lay asphalt paving, and this derives primarily from the fact that a slab of concrete mix cannot be laid against a previously laid slab of concrete mix that is still plastic, whereas a strip of asphalt can be laid against a still plastic strip of asphalt.

SUMMARY OF THE INVENTION

One of the principal objects of the present invention is to provide a process and machine for paving large expanses with concrete in a single uninterrupted operation. Another object is to provide a machine and process of the type stated where the concrete is laid in strips or slabs without any voids between those strips or slabs. A further object is to provide a machine of the type stated which has the capability of laying a slip-formed slab of concrete paving along and adjacent to a previously laid slab that is still plastic. An additional object is to provide a machine of the type stated that derives its elevation and steering from the previously laid slab. Still another object is to provide a slip-forming mule which has the foregoing capabilities and may be used on a conventional automated slip-forming machine. These and other objects and advantages will become apparent hereinafter.

DESCRIPTION OF THE DRAWINGS

In the accompanying drawings which form part of the specification and wherein like numerals and letters refer to like parts wherever they occur—

FIG. 6 is a partial plan and sectional view of the mule taken along line 6—6 of FIG. 5; and FIG. 7 is a rear elevational view of the mule taken along line 7—7 of FIG. 5.

DETAILED DESCRIPTION

Figure 1:
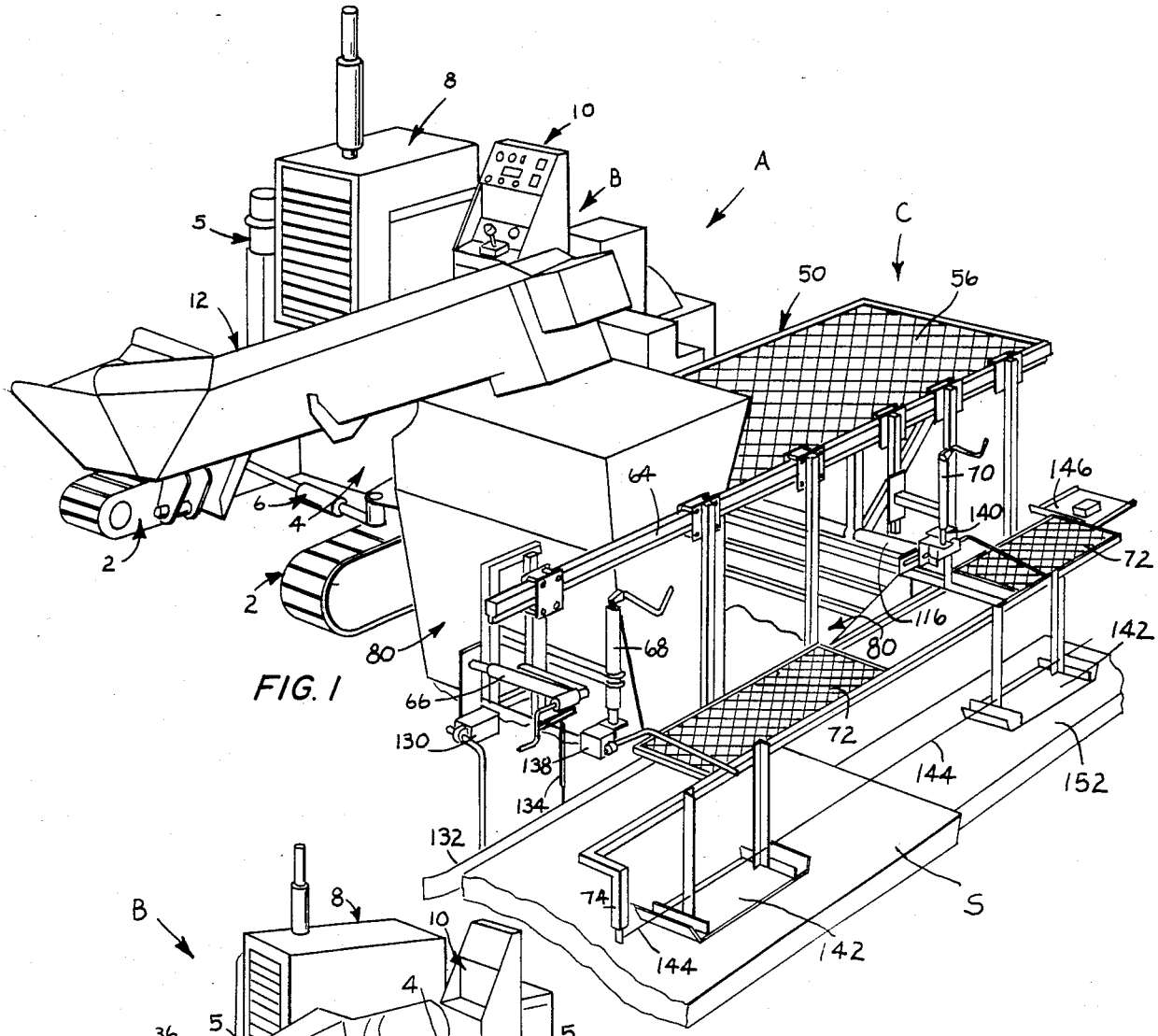
FIG. 1 is a perspective view of a slip-forming machine constructed in accordance with and embodying the present invention, the view illustrating both the tractor and mule that comprises the machine.

Referring now to the drawings, a slip-forming machine A (FIG. 1) for laying a strip or slab s of concrete pavement includes a tractor B and a mule C that is mounted on the tractor B. As the tractor B advances along a predetermined path concrete mix extrudes from the mule C to create a strip or slab s of concrete paving, and that slab s may be laid in an isolated condition or it may be laid adjacent to a previous laid slab s, the concrete mix of which is still plastic. The tractor B is conventional and may be of the type manufactured by Miller Formless Co., Inc., of McHenry, Ill. Being a conventional slip-forming tractor, the tractor B will accommodate a wide variety of mules, which are devices through which concrete mix is extruded onto the ground. The mule C extrudes concrete in the shape of a slab or more specifically in a slab-like strip s about five feet wide.

Figure 2:
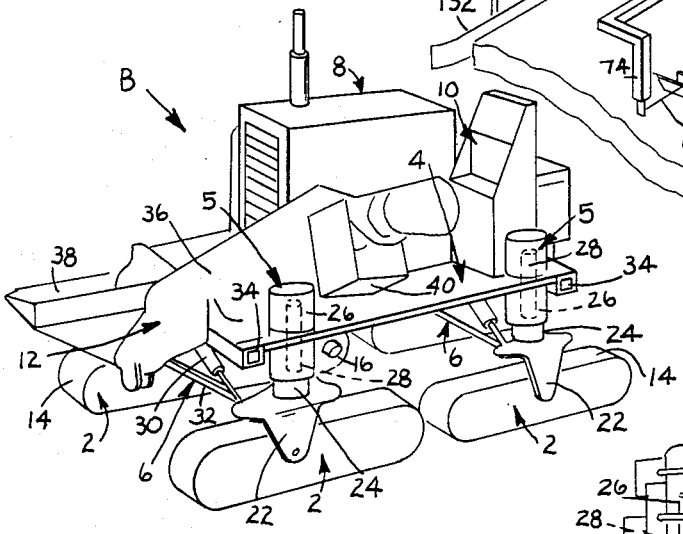
FIG. 2 is a perspective view showing that side of the tractor to which the mule is attached.
Figure 3:
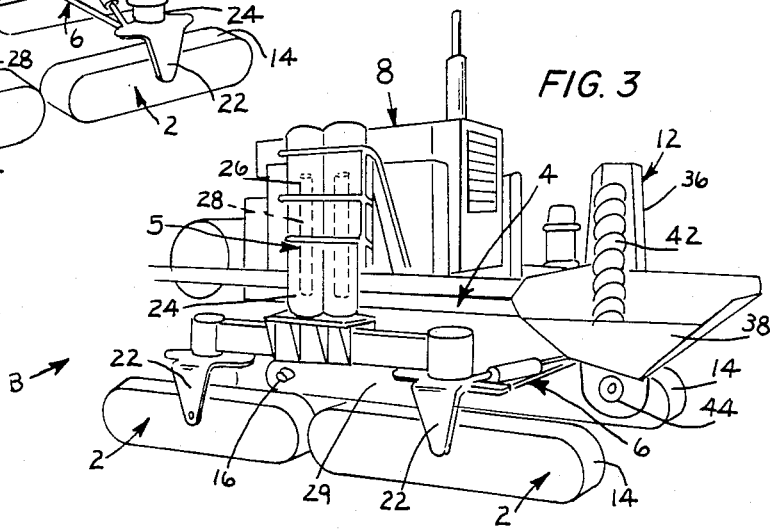
FIG. 3 is a perspective view showing the opposite side of the tractor.

To understand the mule C requires a basic understanding of the tractor B on which the mule C is mounted. The tractor B includes (FIGS. 2 & 3) four track units 2, a chassis 4 that is supported on the track units 2, elevating mechanisms 5 between the track units 2 and the chassis 4, a steering mechanism 6 for each pair of track units 2, a power unit 8 on the chassis 4, a control unit 10 also on the chassis 4, and finally an auger assembly 12 that is carried by the chassis 4.

Each track unit 2 includes an endless track 14 and a hydraulic motor 16 which drives the track 14 so that the track 14 propels the unit 2 along the ground and in so doing carries the chassis 4 along with it. The two track units 2 on one side of the tractor B are independent of each other in the sense that they are connected to the chassis 4 through separate elevating mechanisms 5 (FIG. 2), each of which includes a swivel bracket 22 which is connected to the unit 2 midway between its ends and pivots about an axis that is parallel to the axes about which the sprockets for the track 14 revolve. Each independent elevating mechanism 5 further includes a lower tube 24 that is attached to the bracket 22 and an upper tube 26 that is fastened to the chassis 4, and the tubes 24 and 26 not only telescope relative to each other, but also are free to rotate relative to each other. Within the each set of tubes 24 and 26 is a hydraulic cylinder 28 which effects the telescopic movement and thereby elevates or lowers that corner of the chassis 4 to which the elevating mechanism 5 is attached. The rotational movement between the two tubes 24 and 26, on the other hand, is effected by the steering mechanism 6. The two track units 2 on the other side of the tractor B are connected through swivel brackets 22 to a common bar 29 (FIG. 3) and the bar 29 in turn is connected to the chassis 4 through a pair of elevating mechanisms 5, located midway between the ends of the chassis 4. These elevating mechanisms 5 likewise include lower and upper tubes 24 and 26 and cylinders 28 in the tubes 24 and 26, but the cylinders 28 do not act independently of each other, nor do they rotate.

One steering mechanism 6 turns the front track units 2 in unison, while the other steering mechanism 6 turns the rear track units 2, likewise in unison. Each steering mechanism 6 includes a hydraulic cylinder 30 (FIG. 2) connected between chassis 4 and the track units 2 and tie rods 32 for maintaining the track units 2 of each pair parallel. The tie rods 32 extend between the brackets 14 of the elevating mechanisms 5.

The chassis 4 is in essence a frame possessing a generally rectangular configuration with the elevating mechanisms 5 attached to it for supporting it above the track units 2. The chassis 4 has two tubular cross members 32 (FIG. 2) which extend across the chassis 4 and have their ends open and exposed at the side of the tractor B where the independent elevating mechanisms 5 are located. Here the cross members 34 are provided with clamping screws. The mule C is attached to the chassis 4 at the two cross members 34 and is located opposite the exposed ends of the members 34. This places the mule C along the side of the tractor B at which the independent elevating mechanisms are located (FIG. 1).

The power unit 8 is supported on the chassis 4 on the side opposite from the mule C, and it includes an internal combustion engine and a hydraulic pump that is driven by the engine. The power unit 10 supplies the pressurized hydraulic fluid that is necessary to energize the hydraulic motors 16 on the track units 2. It also supplies the fluid for operating the cylinders 28 of the elevating mechanisms 5 and the cylinders 30 of the steering mechanisms 6.

The control unit 10 is also supported on the chassis 4 and directs the pressurized fluid supplied by the power unit 8 to the motor 16 such that the tractor B advances over the ground at the desired speed. It also directs fluid to the cylinders 28 of the elevating mechanisms 5 to carry the chassis 4 and the mule C attached to it at the proper elevation, and this control may be automatic in the sense that it is derived from sensing devices. Likewise the control unit 10 directs fluid to the cylinders 30 of the steering mechanisms 6, either singly or in combination, and again this steering control may be derived from a sensor, and therefore be automatic.

The auger assembly 12 (FIGS. 2 & 3) is attached to the front of the chassis 4 and includes an inclined trough 36 having a small hopper 38 at its lower end and a spout 40 at its upper end which is located over the mule C. The trough 36 contains an auger or screw 42 that extends from the hopper 38 to the spout 40 and indeed lifts concrete mix from the region of the hopper 38 to the spout 40 where it falls into the mule C. The screw 42 is powered by a rotary hydraulic motor 44 which derives pressurized fluid from power unit 8.

Figure 4:
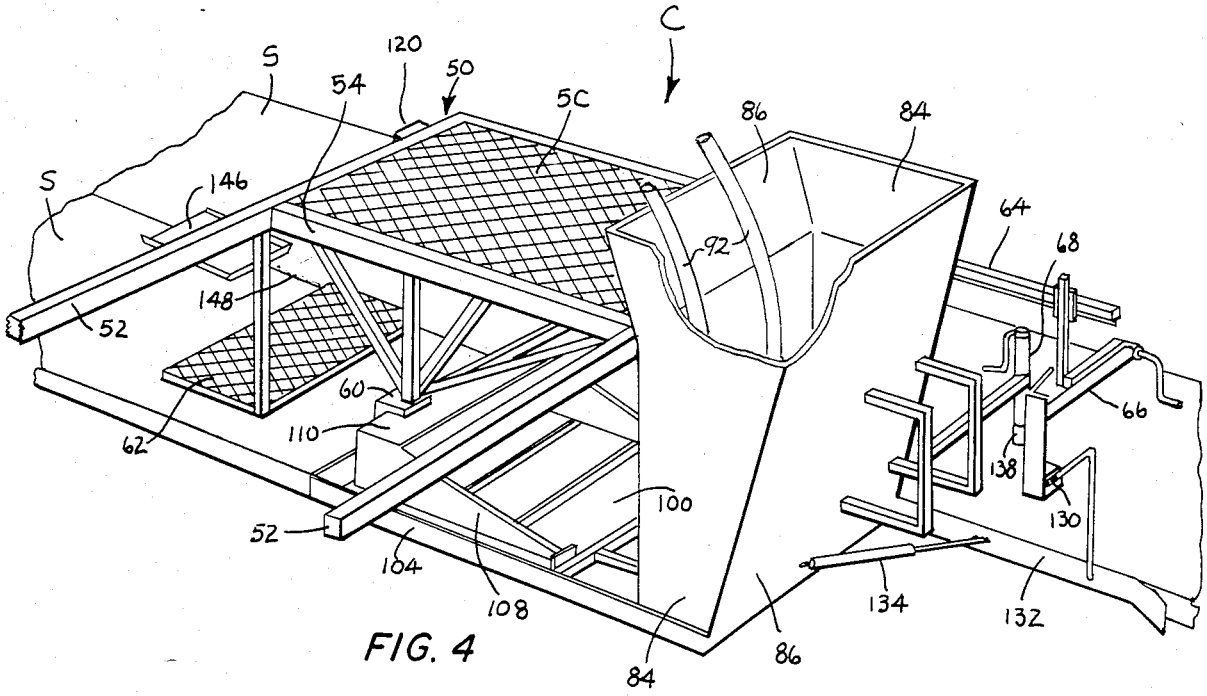
FIG. 4 is a perspective view of the mule.
Figure 5:
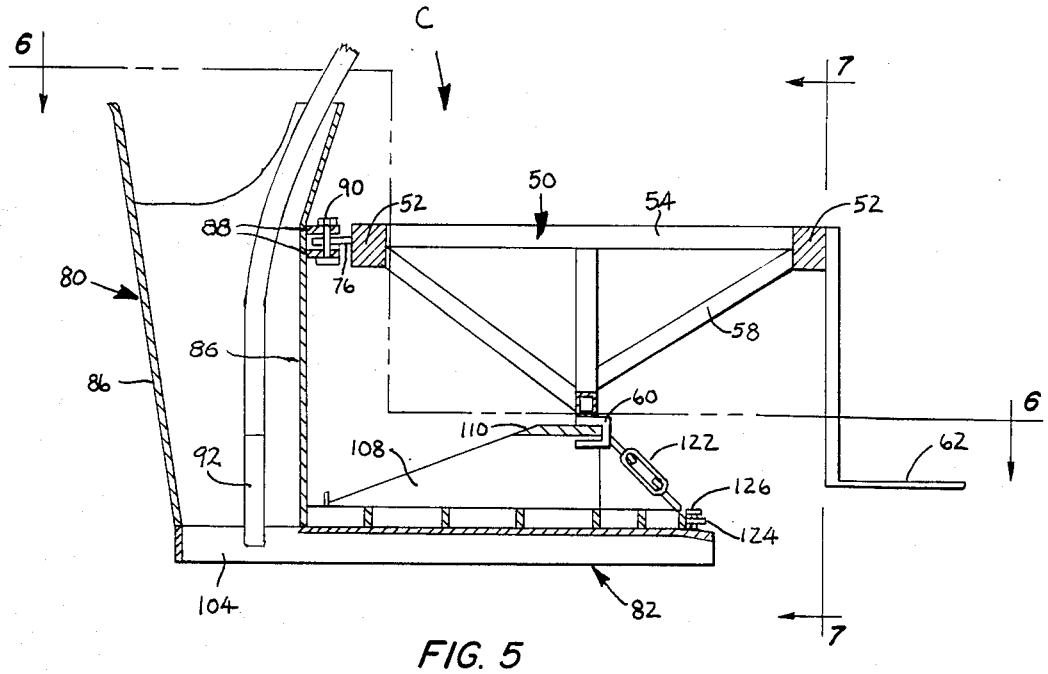
FIG. 5 is a sectional view of the mule taken along line 5—5 of FIG. 4.

The mule C is mounted upon and carried by the tractor B generally on that side of the tractor B that is opposite from the power unit 8 and the control unit 10, that side being the side at which the independent elevating mechanisms 5 are located (FIG. 1). As such, the mule C is positioned beyond, that is laterally from the front and rear track units 2 on the one side of the tractor B. The mule C includes a main frame 50 having a pair of mounting beams 52 (FIG. 4) that fit into the tubular cross members 34 on the chassis 4 of the tractor B and are secured in place by clamping screws which are turned down against beams 52. Thus, the distance that the mule C is positioned beyond the side of the tractor B may be varied. The mounting beams 52 are joined together by tie members 54 and extended over the members 52 and 54 is a deck 56. In addition, the frame 50 includes a form carrier 58 (FIGS. 4, 5 & 7) that is suspended from and tied into the mounting beams 52 and tie members 54. At its lower end the form carrier 58 has brackets 60 that have forwardly opening slots which form a slideway. To the rear of the form carrier 58, the frame 50 supports a rear platform 62 which is considerably lower than the deck 56, and indeed is low enough to be mounted with a single relatively short step.

While the beams 52 at one side of the mule C are free so that they can be inserted into the tubular cross members 34 of the tractor chassis 4, the opposite ends of the beams 52 are welded to a longitudinal side bar 64 that extends horizontally the full length of the mule C and provides a mount for various sensing devices which control the direction and elevation of the mule C (FIGS. 1 & 6). In particular, at its forward end, the bar 64 carries both a steering sensor mount 66 and a forward elevation sensor mount 68. At its rear end, directly outwardly from the form carrier 58, the bar 64 supports a rear elevation sensor mount 70. The two elevation sensor mounts 66 and 68 are adjustable in the vertical direction. The steering sensor mount 66, on the other hand, is adjustable horizontally in the lateral direction, that is parallel to the two mounting beams 52.

The frame 50 supports side platforms 72 (FIGS. 1 & 6) which are suspended from the bar 64 and are located at generally the elevation of the rear platform 62. The front side platform 72 itself is located laterally beyond the frame 50, it having a tow bar 74 projecting forwardly from it and then still further laterally.

Completing the frame 50 is a pivot tongue 76 (FIGS. 5 & 6) which projects forwardly from the forward of the two mounting beams 52 and is welded to that beam in a horizontal disposition.

The two mounting beams 52, the tie members 54, the form carrier 58, the longitudinal side bar 64 and the pivot tongue 76 are united in a single weldment which is in effect the frame 50. Since the frame 50 is coupled to the chassis 4 of the tractor B, it moves with the tractor B and undergoes any changes in direction and elevation experienced by the tractor B, that is by the chassis 4 of the tractor B.

The primary function of the frame 50 is to support a hopper 80 and a slip form 82 which themselves are united together as a single weldment, yet are free to pivot relative to the frame 50 about a vertical axis so that the hopper 80 and slip form 82 may, to a measure, be steered independently of the frame 50 and the tractor B to which they are secured. The hopper 80 is disposed beneath the spout 40 of the auger assembly 12, so that the concrete mix which is elevated by the screw 42 is discharged into the hopper 80. It has straight side walls 84 and front and rear walls 86 which converge downwardly.

At its lower end the hopper 80 opens into the slip form 82 which is a three-sided structure that is open at its front, bottom and rear, but is otherwise closed. The concrete passes from the lower end of the hopper 80 into the slip form 82 where it is laid upon the surface over which the slip form 82 passes, in effect, being extruded from the rear end of the slip form 82.

The spacing between the side walls 84 of the hopper 80 is almost as great as the width of the slip form 82. The rear wall 86 of the hopper 80 is reinforced and has a pair of horizontal pivot plates 88 (FIGS. 5 & 6) welded to it. The pivot tongue 76 on the main frame 50 projects into the space between the two pivot plates 88 and a pivot pin 90 extends through the two plates 88 and the tongue 76 midway between the side walls 84 of the hopper 80. The pin 90 permits the hopper 80 and slip form 82 to turn relative to the frame 50. The hopper 80 also has several spud vibrators 92 located within it, and these vibrators are preferably hydraulically operated, being connected to power unit 8 of the tractor through flexible hydraulic lines.

The slip form 82 is attached rigidly to the lower end of the hopper 80 and extends rearwardly therefrom beneath the form carrier 58 on the main frame 50. Indeed, the rear end of the slip form 82, that is the end from which the concrete is extruded, is located immediately ahead of the rear platform 62 and inwardly from the rear side platform 72. It includes (FIGS. 5–7) a top wall 100 and left and right side walls 102 and 104, respectively. The top wall 100 is about as wide as the hopper 80, and thus being quite expansive, is reinforced with cross ribs 106. The side walls 102 and 104, on the other hand, are quite short, being no higher than about the thickness of the paving which is desired, and normally that is no more than about four inches. The rear ends of the two side walls 102 and 104 coincide with the rear margin of the top wall 100, but the side walls 102 and 104 project forwardly beyond the forward end of the top wall 100, so that they are disposed at the sides of the hopper 80 as well. In short, the side walls 84 of the hopper 80 merge into the side walls 102 and 104 of the slip form 82.

Rearwardly from the hopper 80, the top wall 100 of the slip form 82 has a pedestal 108 across which a rearwardly projecting slideway or track 110 (FIGS. 5–7) extends. Indeed, the track 110 projects into the forwardly opening slots that form the slideway in the brackets 60 at the bottom of the form carrier 58. In this manner, the slip form 82, or more precisely the rear portion of the slip form 82, is supported on the main frame 50, yet is free to move a limited distance left or right to accommodate pivoting of the hopper 80 and slip form 82 about the pivot pin 90. While the rear portion of the slip form 82 is supported on the form carrier 58, the forward portion of the slip form 82 is attached to the bottom of the hopper 80 and thus is, along with the hopper 80, suspended from the pivot tongue 76.

The pedestal 108 also includes a thrust arm 112 (FIGS. 6 & 7) which is directed laterally toward the left side wall 102 on the slip form 82, and indeed the outer end of the arm 112 is rigidified by a short member 114 which extends between the arm 112 and the left side wall 102. Extended over the thrust arm 112 is a double acting hydraulic cylinder 116 which at its inner end is connected to the lower end of the form carrier 58 and at its outer end is connected to the remote end of the thrust arm 112. When energized the cylinder 116 causes the hopper 80 and slip form 82 to turn about the pivot pin 90, in which case the track 110 will slide within the brackets 60.

The hydraulic cylinder 116 is connected through flexible hydraulic lines to the power unit 8 of the tractor B. The hydraulic circuitry to the cylinder 116 includes a pressure regulator which normally directs fluid at a predetermined pressure to the cap end of the cylinder 116 so that the cylinder 116 urges the slip form 82 laterally, that is to the left and away from the tractor B, with a predetermined force. The circuitry also includes an override valve 120 (FIGS. 4 & 7) which is located on the frame 50 and is accessible to one standing on the rear platform 62. The valve 120 is connected such that when actuated it will override the pressure regulator and urge the slip form 82 to either the left or right with varying force.

Ahead of the pedestal 108, the top wall 100 of the slip form 82 is attached firmly to the side walls 102 and 104, but behind the pedestal 108 the top wall 100 and side walls 102 and 104 are detached, the detached length amounting to about 10 to 12 inches. Here the top wall 100 is depressed slightly by turn buckles 122 (FIGS. 5–7) which extend between the last cross rib 106 and upper end of the pedestal 108. Moreover, the last cross rib 106 is set slightly ahead of the rear margin of the top wall 100 and along its back side this rib 106 is provided with short tabs 124 through which jack screws 126 are threaded. The jack screws 126 turn down against the upper surface of the top wall 100 slightly ahead of the rear margin of that wall and depress the very end of the wall still further. Thus, while the top wall 100 is for the most part planar, it does turn or curve slightly downwardly at its rear end and this curvature further consolidates the concrete as it leaves the slip form 82 and insures that the concrete does not contain any voids.

The direction of the tractor B may be controlled manually from the control unit 10, but during the laying of pavement it is controlled almost entirely by a steering sensor 130 (FIGS. 1, 4 & 6) which is mounted upon the steering sensor mount 66 and includes a wand that either follows a string line, or more often an edge ski 132 that is hinged to the forward end of the left side wall 102 for the slip form 82 and projects forwardly several feet beyond the hopper 80. The ski 132 is about as high as the left side wall 102 and indeed forms a forward extension of the wall 102. It pivots about a vertical axis and is urged generally to the left by a spring-loaded strut 134 that extends between the ski 132 and the front wall 86 of the hopper 80. The ski 132 is designed to follow the edge of a previously laid slab s of paving (FIGS. 1 & 4), and by reason of its substantial length, it does not move upon encountering minor deformaties in the edge of the slab s. The ski 132 exerts relatively little force on the edge of the previously laid slab s, and hence may be run along the slab s while the concrete mix of the slab s is still plastic. The sensor 130 is connected to the control unit 10, and provides correcting signals which cause the control unit 10 to direct hydraulic fluid to the cylinder 30 of the forward steering mechanism 6 on the tractor B such that the tractor B runs parallel to the string line or edge of the previously laid slab s.

The elevation of the mule C and likewise the chassis 4 of the tractor B is also under the control of the control unit 10 which derives correcting signals from a forward elevation sensor 138 (FIGS. 1 & 6) that is attached to the forward elevation sensor mount 68 and a rear elevation sensor 140 that is attached to the rear elevation sensor mount 70. Both of the mounts 68 and 70 are carried by the side bar 64 that extends longitudinally along the main frame 50 at that side of the mule C which is remote from the tractor B. Actually, the front sensor 138 provides signals that control the elevating cylinder 28 of the left front elevating mechanism 5, while the rear sensor 140 provides signals that control the elevating cylinder 28 of the left rear elevating mechanism 5. The elevating cylinders 28 of the two elevating mechanisms 5 on the right side of the tractor B, that is the side remote from the mule C, are run locked to grade, which means that once they are adjusted to provide the correct elevation for the right side of the tractor B, they are not changed during the operation of the machine A. The initial adjustment of the right elevating mechanism 5 is performed from controls at the control unit 10.

Each of the elevation sensors 138 and 140 has a wand that projects laterally and rides a separate ski 142 (FIGS. 1 & 6) that is towed over a previously laid slab s of pavement that may be and usually is in plastic condition. The forward ski 142 is connected by means of a tow line 144 to the tow bar 74 that projects forwardly from the side platform, while the rear ski 144 is connected by another tow line 144 to the forward ski 142. The length of the two tow lines 144 are such that the forward ski 142 is immediately outwardly from the front of the forward track units 2, and the rear ski 144 is directly outwardly from rear track units 2. Thus, when the forward ski 142 experiences a change in elevation, the forward end of the chassis 4 and likewise the forward end of the slip form 82 will undergo a corresponding change by reason of the left front elevation cylinder 28 having extended or retracted. Similarly, when the rear ski 142 experiences a change in elevation, the left rear elevation cylinder 28 effects a corresponding change in the elevation of the chassis 4 and slip form 82. Each ski 142 is made from aluminum, so as to be light in weight, and is turned upwardly at its forward end to avoid marring the plastic concrete of the slab s over which it rides.

Finally, the mule C is accompanied by a float 146 (FIGS. 1 & 6) which is connected to the slip form 82 by a short tow line 148 and is towed behind the mule C such that it is centered with respect to the left side wall 102 of the slip form 82. The float 146 is turned upwardly along its forward end, and its sides as well, and carries a hydraulic vibrator 150 which is powered by hydraulic fluid from the power unit 8, that fluid being supplied through flexible hydraulic lines.

OPERATION

To prepare the slip-forming machine A for operation, the mule C is first attached to the tractor B. This involves inserting the two mounting beams 52 on the main frame 50 of the mule C into the tubular cross members 34 on the chassis 4 of the tractor B. Also hydraulic lines from the power unit 8 of the tractor B are connected with the spud vibrators 92 in the hopper 80, the hydraulic side loading cylinder 116 and the vibrator 150 on the float 146. In addition, the steering sensor 130 is attached to the steering sensor mount 66, while the forward and rear elevation sensors 138 and 140 are attached to their respective mounts 68 and 70, and each of the sensors 130, 138 and 140 is connected to the control unit 10 for the tractor B.

Aside from placing the machine A in condition for operation, the area which is to be paved must be prepared, but this preparation is certainly no more extensive than required for paving an area with asphalt, and indeed may involve less work. In particular, the area must be graded. Once the grading is completed a string line is stretched over the graded area for guiding the machine A during its first pass. Usually, this line extends through the center of the area, and when the area is oblong, it is desirable to extend the line longitudinally as opposed to transversely.

Once the site has been prepared, the slip-forming machine A is positioned at one end of the string line with the wand of the steering sensor 130 against the line. Moreover, the cylinders 28 of the elevating mechanisms 5 are extended or retracted to bring the slip form 82 into a generally horizontal disposition with the lower edges of its side walls 102 and 104 immediately above the graded surface. The cylinders 28 are then locked in that position so that during the first pass over the prepared site, the machine A will be "locked to grade". Also, the side loading cylinder 116 that extends between the form carrier 58 and the slip form 82 is adjusted such that the side walls 102 and 104 of the slip form 82 are parallel to the sides of the chassis 4 for the tractor B, and the cylinder 116 is locked into that position so that the slip form 82 remains fixed with respect to the tractor B. The two skis 142 and float 146 are not necessary for the first pass across the prepared site and accordingly are not attached to the mule C at this time.

Finally, a concrete transit mixer is positioned alongside the hopper 38 at the lower end of the auger assembly 12 and discharges concrete mix into the hopper 38. The screw 42 elevates this concrete mix through the trough 36 to the spout 40 at the upper end of the auger assembly 12 where the concrete mix is discharged into the hopper 80 of the mule C. The concrete mix should be of a relatively dry character to enable it to retain its shape without any permanent form, but even so the concrete mix will pass into the restricted lower end of the hopper 80 and the even more restricted entrance to the slip form 82, for the vibrators 92 in the hopper 80 agitate the concrete mix enough to enable it to flow or crowd through these restrictions.

After the slip form 82 is filled with concrete mix, the hydraulic motors 16 on the track units 4 of the tractor B are energized to move the tractor B forwardly, and as it advances the wand on its steering sensor 130 follows the string line that is stretched over the prepared site. The steering sensor 130 provides signals to the control unit 10 which in turn causes the hydraulic cylinder 30 of the front steering mechanism 6 to continually shift the two front track units 2 such that the tractor B advances parallel to the line. As the tractor B advances, the concrete mix extrudes from the open rear end of the slip form 82 as a slab s, and by reason of the relatively dry character of the mix the extruded concrete retains the shape of the cross-sectional configuration of the slip form 82 after the form 82 passes beyond it. In this connection, the rear edge of the top wall 100 for the slip form 82 is depressed slightly by the turn buckles 122 and jack screws 126 and this compacts the concrete mix as it extrudes from the form 82, insuring that no voids exist in the resulting slab s. It also provides a good finish to the upper surface of the slab s. The concrete transit mixer advances with the slip-forming machine A and discharges enough concrete mix into the auger assembly 12 to maintain the hopper 80 of the mule C reasonably full. Also concrete finishers follow the mule C to remove any blemishes that may develop in the slab s. These finishers also draw special tools across thc slab to produce scores which, when the concrete mix hardens, develop into regions of weakness at which the concrete will perhaps crack in a uniform manner. The spacing between the scores should be about 1 to 2 times the width of the slab s.

At the end of the first pass over the prepared site, a straight slab s of still plastic concrete will extend from one end of the site to the other. Now the string guide line is removed, and using both front and rear steering mechanisms 6, the slip-forming machine A is turned around and repositioned with its slip form 82 and the edge ski 132 positioned along one of the side edges of the plastic concrete slab s (FIG. 1). Moreover, the steering sensor 130 is repositioned on its mount 66 so that it will follow the edge ski 132 instead of a string line. The two elevation skis 142 are then connected to the tow bar with the line 144, such that they are located to the side of the mule C. Indeed, the forward ski 142 will rest on the upper surface of previously poured slab s, whereas the rear ski will be located beyond the end of the slab s. To give the rear ski 142 the proper elevation, a short platform 152 having the thickness of the slab s is placed beyond the end of the slab s and the rear ski 142 is then placed on the platform 152. With the two elevation skis 142 correctly positioned the elevation sensors 138 and 140 are adjusted by moving their respective mounts 68 and 70, until the wands of those sensors 138 and 140 rest upon the elevation skis 142. At the same time the control unit 10 is changed so that the cylinder 28 of the left front elevation mechanism 5 responds to the front elevation sensor 138, while the cylinder 28 of the left rear elevation mechanism 5 responds to the rear elevation sensor 140. The two cylinders 28 on the other side of the chassis 4, that is the right side, remain locked to grade. The front sensor 138 of course follows the forward ski 142, while the rear sensor 140 follows the rear ski 142. Finally, the float 146 is connected to the slip form 82 directly behind the left wall 102 of that form.

The hydraulic motors 16 of the four track units 2 are again energized and the slip-forming machine A advances along the side of the previously poured slab s. After a few feet the rear ski 142 moves off of the platform 152 and onto the previously poured slab s. Thus, both the front and rear skis move along and are supported on the upper surface of the previously poured slab s, and even though the concrete of that slab is plastic, the skis 142 do not mar it because they have very little weight. During the advance the front elevation sensor 138 detects the level of the upper surface for the previously laid slab s laterally from the left front track unit 2 and adjusts the elevation cylinder 28 at that unit to maintain the slip form 82 at an elevation corresponding to that of the previously laid slab s. Likewise, the rear elevation sensor 140 detects the elevation of the slab s laterally from the left rear track unit 2 and adjusts the elevation cylinder 28 at that unit in a similar manner. As a result the concrete extrudes from the slip form 82 such that the upper surface of the new strip or slab s is flush with the upper surface of the previously laid slab s.

The edge ski 132, on the other hand, follows the edge of the previously laid slab s, it being urged against that edge by the spring loaded strut 134, and the steering sensor 130 senses the position of the edge ski 132 and causes the hydraulic cylinder 30 of the front steering mechanism 6 to move the two front track units 2 such that the machine A advances on a course that is precisely parallel to the edge of the previously formed slab. Only the front steering mechanism 6 is used during automatic operation, for when both the front and rear mechanisms 6 are operated, the machine A tends to overcorrect for signals derived from the steering sensor 130. While the side edge may contain some imperfections, the edge ski 132, being of substantial length, insulates the wand of the steering sensor 130 from these imperfections, so the sensor 130 only detects a true drift from the parallel course, and adjusts the front steering cylinder 30 to correct for that drift.

At about the time that the rear elevation ski 142 moves onto the top surface of the previously laid slab s the full side of the slip form 82 will be along the edge of the previously laid slab s, and at this time the side loading cylinder 116 between the slip form 82 and form carrier 58 is energized through the pressure regulator and valve 120 to thrust the slip form 82 laterally so that its left side wall 102 bears with substantial force against the edge of the previously laid slab s. In this regard, the slip form 82 at its forward end pivots about the pin 90, while the track 110 at its rear end will slide in the brackets 60 of the form carrier 58, all while maintaining the elevation established by the elevation cylinders 28 on the tractor B. The force exerted by the side loading cylinder 116 for normal pavement should be about 200 pounds, and as a result of this force, the concrete mix extrudes from the slip form 82 immediately adjacent to the previously laid slab s. Indeed, the extruded concrete mix tends to "boil over" onto the upper surface of the previously laid slab s, insuring that the slab s being extruded abuts the previously laid slab s. The float 146 which trails the slip form 82, passes over the concrete mix which comes up onto the adjacent slab s and eliminates any blemishes that might otherwise occur by reason of the boil over.

A workman precedes the advancing machine A and sprays a bond inhibitor onto the edge of the previously laid slab s so that the concrete being extruded does not, despite the edge-to-edge abutment, bond firmly to that slab s. This permits a crack to develop where the two slabs s abut and this in turn accommodates the expansions and contractions that invariably occur. As a result, a crack will probably develop along the joint, but the crack will be straight. The cement finishers, on the other hand, follow the machine A and eliminate blemishes. They further score the newly laid slab s such that the score marks align with the score marks in the previously laid slab s. Also, it may be desirable to impart a rough texture to the pavement to improve traction once the concrete sets. This may be achieved by dragging a rug of artificial grass behind from the machine with the rug being positioned such that it passes over the previously laid slab s, but not the slab s being extruded.

In time, the machine A will come to the other end of the prepared site, and to prevent the forward elevation ski 142 from dropping downwardly at the end of the previously laid slab s and thereby disturbing the elevation of the slip form 82, the platform 152 which guided the rear ski 142 onto the newly laid slab s is placed ahead of the forward ski 142 so that the forward ski 142 runs out onto it and maintains the same elevation as the slip form 82 comes to the end of the previously laid slab s. Also at this time the steering control is removed from the steering sensor 130 and performed manually.

The machine A is then turned around, preferably by using both steering mechanisms 6, and another slab s is laid along the exposed edge of either the slab s just completed or the initial slab s. Additional slabs s are completed in a similar manner.

Thus, by means of the improved slip-forming machine A, slabs s of concrete can be laid alongside previously laid slabs s which are still plastic. In this manner an entire site may be paved without interruption. In short, the common practice of stripping, that is laying the slabs in spaced apart strips, is eliminated along with the long delay that is necessary for the initial strips to achieve a sufficient state of cure to support concrete-carrying vehicles.

The slip-forming machine A is suitable for paving over surfaces other than grade. For example, it may be used to place concrete paving over existing paving such as deteriorated asphalt. The mule C with modifications is suitable for use on other types of tractors.

This invention is intended to cover all changes and modifications of the example of the invention herein chosen for purposes of the disclosure which do not constitute departures from the spirit and scope of the invention.

What is claimed is:

1. A paving process comprising: extruding concrete mix onto a surface to provide a first slab having a generally flat upper surface and side edges; thereafter extruding a second extending slab immediately adjacent to the first slab while the concrete mix of the first slab is still plastic, the second slab having a generally flat upper surface which is flush with the upper surface of the first slab and side edges, one side edge of the second slab being directly against and abutting a side edge of the first slab, the second slab being extruded through a slip form that is moved along the side of the first slab and has spaced apart first and second side walls and a top wall extended between the side walls, the first side wall of the slip form being urged firmly against the edge of the first slab as the slip form moves along the first slab and extrudes concrete mix; and allowing the concrete mix of the two slabs to harden.

2. The process according to claim 1 and further comprising adjusting the elevation of the slip form, while the second slab is extruded, by means of elevation signals derived from the upper surface of the first slab.

3. The process according to claim 2 wherein the step of adjusting the elevation of the slip form includes passing a ski over the upper surface of the first slab and sensing the elevation of the ski.

4. The process according to claim 2 and further comprising adjusting the direction of the slip form, while the second slab is extruded, by means of steering signals derived from that edge of the first slab against which the second slab is extruded.

5. The process according to claim 4 wherein the step of adjusting the direction of the slip form includes passing an edge ski along that edge of the first slab against which the second slab is extruded, and sensing the lateral position of the edge ski.

6. The process according to claim 1 and further comprising applying to that edge of the first slab against which the second slab is extruded a substance that inhibits concrete from bonding to more concrete, whereby the two slabs do not bond strongly to each other.

7. The process according to claim 1 and further comprising imparting transverse score marks to the slabs while the concrete mix of the slabs is still plastic.

8. A machine for laying a slab of concrete adjacent to a previously laid slab of concrete that may still be in a plastic condition, said machine comprising: a tractor capable of moving over the ground in a direction of advance; a frame mounted rigidly on the tractor and including a generally horizontal slideway; a hopper carried by the frame for receiving a concrete mix; a slip form also carried by the frame and having a top wall and spaced apart first and second side walls which are fixed in position with respect to the top wall, at least the first side wall being located beyond the side of the tractor and further being unobstructed on its outwardly presented face so that it may be brought against the edge of the previously laid slab of concrete without having the tractor move upon such previously laid slab or otherwise damaging the edge of that slab, the slip form also having an open bottom, a leading end that is connected with the hopper so that concrete mix will flow from the hopper into the slip form and an open trailing end from which the concrete mix extrudes as the tractor moves the slip form over the ground, the slip form at its leading end being supported on the frame such that it can pivot relative to the frame about a generally vertical axis, the slip form further having a slide that is located above its top wall and to the rear of the pivot axis, with the slide being engaged with the slideway on the frame such that the slip form in the region of its slide is prevented from moving upwardly or downwardly but may move laterally, whereby the trailing end of the slip form is supported by the slide; and force exerting means connected between the slip form and the frame for adjusting the lateral position of the trailing end of the slip form with respect to the frame and for further urging the trailing end of the slip form against the edge of the previously laid slab of concrete with substantial force, whereby the concrete which extrudes from the trailing end of the slip form forms a slab that is adjacent to the previously laid slab.

9. A machine according to claim 8 and further comprising steering means for controlling the general direction of the tractor and the slip form that is propelled by the tractor.

10. A machine according to claim 9 wherein the steering means includes an edge ski which bears against and follows that edge of the previously laid slab against which the extruded concrete mix is laid and second sensor means mounted on the frame for determining the position of the edge ski.

11. A machine according to claim 10 wherein the edge ski is mounted on the leading end of the first side wall for the slip form and pivots relative to the slip form about a vertical axis that is located ahead of the axis about which the slip form pivots relative to the frame.

12. A machine according to claim 8 wherein the force exerting means includes a fluid-operated cylinder connected between the frame and the slip form remote from the axis of the pivot.

13. A machine according to claim 8 wherein the tractor includes several endless track units, two of which are closest to the slip form; and separate fluid-operated cylinders connected between the two track units closest to the slip form and the frame, sensing means for sensing the elevation of the upper surface of the previously laid slab of concrete mix and for actuating the fluid-operated cylinders in response to the sensing means so as to maintain the upper surface of the concrete mix that is being extruded flush with the upper surface of the previously laid slab of concrete mix.

14. A machine according to claim 8 and further comprising a float towed by the slip form and aligned with the first side wall of the slip form that is urged against the edge of the previously laid slab of concrete mix.

15. A machine according to claim 8 wherein the frame projects beyond the side of the tractor and supports the slip form entirely beyond the side of the tractor.

16. A machine according to claim 8 wherein the hopper and slip form are joined rigidly together and the hopper is connected to and supported on the frame at a pivot, the axis of which is the vertical axis about which the leading end of the slip form pivots relative to the frame.

17. A machine according to claim 16 and further comprising means on the frame for elevating the concrete mix to the hopper.

18. A machine according to claim 8 and further comprising means for controlling the elevation of the slip form.

19. A machine according to claim 18 wherein the means for controlling the elevation of the slip form automatically positions the slip form such that the upper surface of the concrete mix extruded from the slip form is generally flush with the upper surface of the previously laid slab of concrete mix.

20. A machine according to claim 19 wherein the means for controlling the elevation includes at least one ski that is positioned on and rides the upper surface of the previously laid slab of concrete mix and is propelled by the tractor means so that it moves with the frame, and first sensor means mounted upon the frame for determining the elevation of the ski relative to the frame.

21. A process for laying a slab of concrete mix along a previously laid slab that is still plastic and has an edge along its side, said process comprising: moving a tractor along a path that is to the side of the previously laid slab, with the tractor carrying a frame and a slip form supported on the frame such that its leading end pivots relative to the frame about a vertical axis while its trailing end is free to move laterally limited distance, but is confined in the vertical direction, the slip form having spaced apart first and second side walls and a top wall extended between the side walls, the first side wall being unobstructed on its outwardly presented surface; introducing a concrete mix into the slip form in sufficient quantity to enable the concrete mix to extrude from the trailing end of the slip form as a slab, guiding the tractor along the path by sensing its position relative to the edge of the previously laid slab; and forcing the slip form laterally toward the previously laid slab so that the unobstructed outwardly presented surface of the first side wall for the slip form bears with considerable force against the edge of the previously laid slab as the concrete mix extrudes from the slip form; and adjusting the height of the slip form so that the concrete mix extruded from it is essentially flush with the previously laid slab.

22. The process according to claim 21 wherein the step of adjusting the height comprises moving skis over the previously laid slab adjacent to the tractor with the skis being propelled by the tractor, and sensing changes in elevation between the skis and the tractor.

23. The process according to claim 22 wherein the step of guiding the tractor includes moving an edge ski along the edge of the previously laid slab, and sensing changes in position of the edge ski relative to the tractor.

24. The process according to claim 23 wherein the edge ski pivots on the first side wall of the slip form.

25. The process according to claim 21 wherein the step of adjusting the height of the slip form comprises moving first and second skis over the previously laid slab adjacent to the slip form, with the first ski being at the leading end of the slip form and the second ski at the trailing end of the slip form, sensing changes in elevation between the skis and the tractor, and at the beginning of the slab starting the second ski on a removable platform that rises to the same elevation as the previously laid slab, so the second ski moves off of the platform and onto the previously laid slab.

* * * * *